US006564679B1

(12) United States Patent
Llamas et al.

(10) Patent No.: US 6,564,679 B1
(45) Date of Patent: May 20, 2003

(54) APPLIANCE CLUTCH REMOVAL AND INSTALLATION TOOL

(76) Inventors: Tony A. Llamas, 596 Leaf Haven, Windsor, CA (US) 95492; Ken P. Glaser, 4431 Kearny Dr., Prescott Valley, AZ (US) 86314

( * ) Notice: Subject to any disclaimer, the term of this patent is extended or adjusted under 35 U.S.C. 154(b) by 0 days.

(21) Appl. No.: 10/047,194

(22) Filed: Oct. 26, 2001

(51) Int. Cl.[7] ..... B25B 13/48

(52) U.S. Cl. ..... 81/176.15; 81/124.2

(58) Field of Search ..... 81/176.15, 176.2, 81/119, 120, 121.1, 124.2, 124.3, 124.7

(56) References Cited

U.S. PATENT DOCUMENTS

| | | | | | |
|---|---|---|---|---|---|
| 342,824 | A | * | 6/1886 | Clark | 81/125.1 |
| 1,321,776 | A | * | 11/1919 | Stepanian | 81/124.2 |
| 1,397,876 | A | * | 11/1921 | Meldal | 411/427 |
| 1,867,372 | A | * | 7/1932 | McGuckin | 81/124.2 |
| 2,116,770 | A | * | 5/1938 | Scillia | 137/326 |
| 2,405,462 | A | * | 8/1946 | Stair | 76/114 |
| 2,445,905 | A | * | 7/1948 | Busby | 81/124.3 |
| 2,619,861 | A | * | 12/1952 | Wanamaker | 81/176.15 |
| 3,086,414 | A | | 4/1963 | Nardi | 81/90 |
| 4,125,913 | A | * | 11/1978 | Lewis | 7/138 |
| D261,606 | S | * | 11/1981 | La Fargo et al. | D8/21 |
| 4,562,758 | A | | 1/1986 | Stirling | 81/124.4 |
| 4,836,065 | A | * | 6/1989 | Setliff | 81/124.2 |
| 4,846,025 | A | | 7/1989 | Keller et al. | 81/3.09 |
| 5,048,378 | A | | 9/1991 | Nikolas | 81/124.2 |
| 5,295,291 | A | * | 3/1994 | Harris | 29/274 |
| 5,425,289 | A | * | 6/1995 | Iwinski | 81/3.4 |
| 5,542,321 | A | | 8/1996 | Fuca | 81/125.1 |
| 5,575,602 | A | | 11/1996 | Savage et al. | 411/405 |
| 5,697,268 | A | | 12/1997 | Makovsky et al. | 81/125 |
| 5,887,496 | A | | 3/1999 | Pollard et al. | 81/461 |
| 5,957,011 | A | * | 9/1999 | Thompson | 81/176.15 |
| 6,044,502 | A | * | 4/2000 | Fountain | 4/661 |
| 6,044,732 | A | | 4/2000 | Astle | 81/176.15 |
| 6,058,813 | A | * | 5/2000 | Bryant et al. | 81/176.15 |
| 6,082,230 | A | * | 7/2000 | Steinweg | 81/176.15 |
| 6,374,708 | B1 | * | 4/2002 | Kunz | 81/124.2 |

* cited by examiner

*Primary Examiner*—Joseph J. Hail, III
*Assistant Examiner*—David B. Thomas

(57) ABSTRACT

An appliance clutch removal and installation tool for providing a convenient device for removing and installing an appliance clutch. The appliance clutch removal and installation tool includes a body member preferably having a relatively elongate structure, a first handle and a second handle attached to an upper end of the body member, and a plurality of cutouts extending into a lower end of the body member defining a plurality of engaging members. Each of the engaging members has a first side and a second side tapering inwardly from the exterior of the body member. The plurality of cutouts receive a corresponding plurality of teeth from the clutch member wherein the plurality of engaging members engage the teeth. The user rotates the body member while securing the threaded shaft thereby removing or installing the clutch member about the threaded shaft of the appliance.

20 Claims, 7 Drawing Sheets

APPLIANCE CLUTCH REMOVAL AND INSTALLATION TOOL

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to appliance clutches and more specifically it relates to an appliance clutch removal and installation tool for providing a convenient device for removing and installing an appliance clutch.

2. Description of the Prior Art

Appliance clutches, such as those utilized upon blenders, have been in use for years. A conventional clutch for an appliance, such as a blender, is comprised of two opposing clutch members that each have plurality of teeth extending outwardly that mate with one another. The first clutch member is mechanically attached to a motor device and the second clutch member is attached to a device that is to be driven such as the blades of a blender within the blender container. The clutch members are typically threadably attached to a threaded shaft member. Various appliances, commercial and residential, utilize this conventional mating clutch system to allow for simple usage of the appliances.

The main problem with conventional appliance clutches is that they are difficult to remove and replace. Conventional appliance clutches are difficult to manipulate utilizing a user's bare hand and requires the usage of conventional tools that simply are not adequate to grasp the clutch member. In addition, individuals often times have to contact a professional to replace a worn appliance clutch which can be relatively expensive. Furthermore, hiring a professional to replace an appliance clutch is time consuming and removes the appliance from the business during the repair period.

Examples of patented devices which are possibly related to the present invention include U.S. Pat. No. 5,048,378 to Nikolas; U.S. Pat. No. 5,542,321 to Fuca; U.S. Pat. No. 4,562,758 to Stirling; U.S. Pat. No. 6,044,732 to Astle; U.S. Pat. No. 5,887,496 to Pollard et al.; U.S. Pat. No. 5,697,268 to Makovsky et al.; U.S. Pat. No. 5,575,602 to Savage et al.; U.S. Pat. No. 4,846,025 to Keller et al.; U.S. Pat. No. 4,836,065 to Setliff; and U.S. Pat. No. 3,086,414 to Nardi.

While these devices may be suitable for the particular purpose to which they address, they are not as suitable for providing a convenient device for removing and replacing an appliance clutch. Conventional tools such as screwdrivers and the like are not adequate for manipulating a clutch member during removal and installation thereof.

In these respects, the appliance clutch removal and installation tool according to the present invention substantially departs from the conventional concepts and designs of the prior art, and in so doing provides an apparatus primarily developed for the purpose of providing a convenient device for removing and replacing an appliance clutch.

SUMMARY OF THE INVENTION

In view of the foregoing disadvantages inherent in the known types of tools now present in the prior art, the present invention provides a new appliance clutch removal and installation tool construction wherein the same can be utilized for providing a convenient device for removing and replacing an appliance clutch.

The general purpose of the present invention, which will be described subsequently in greater detail, is to provide a new appliance clutch removal and installation tool that has many of the advantages of the conventional tools mentioned heretofore and many novel features that result in a new appliance clutch removal and installation tool which is not anticipated, rendered obvious, suggested, or even implied by any of the prior art tools, either alone or in any combination thereof.

To attain this, the present invention generally comprises a body member preferably having a relatively elongate structure, a first handle and a second handle attached to an upper end of the body member, and a plurality of cutouts extending into a lower end of the body member defining a plurality of engaging members. Each of the engaging members has a first side and a second side tapering inwardly from the exterior of the body member. The plurality of cutouts receive a corresponding plurality of teeth from the clutch member wherein the plurality of engaging members engage the teeth. The user rotates the body member while securing the threaded shaft thereby removing or installing the clutch member about the threaded shaft of the appliance.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an appliance clutch removal and installation tool that will overcome the shortcomings of the prior art devices.

A second object is to provide an appliance clutch removal and installation tool for providing a convenient device for removing and replacing an appliance clutch.

Another object is to provide an appliance clutch removal and installation tool that does not require a professional to repair an appliance clutch.

An additional object is to provide an appliance clutch removal and installation tool that reduces the time required to repair an appliance clutch.

A further object is to provide an appliance clutch removal and installation tool that engages various sizes of clutch members.

Another object is to provide an appliance clutch removal and installation tool that may be utilized by various types of businesses and professionals such as restaurants, bars, and service technicians.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
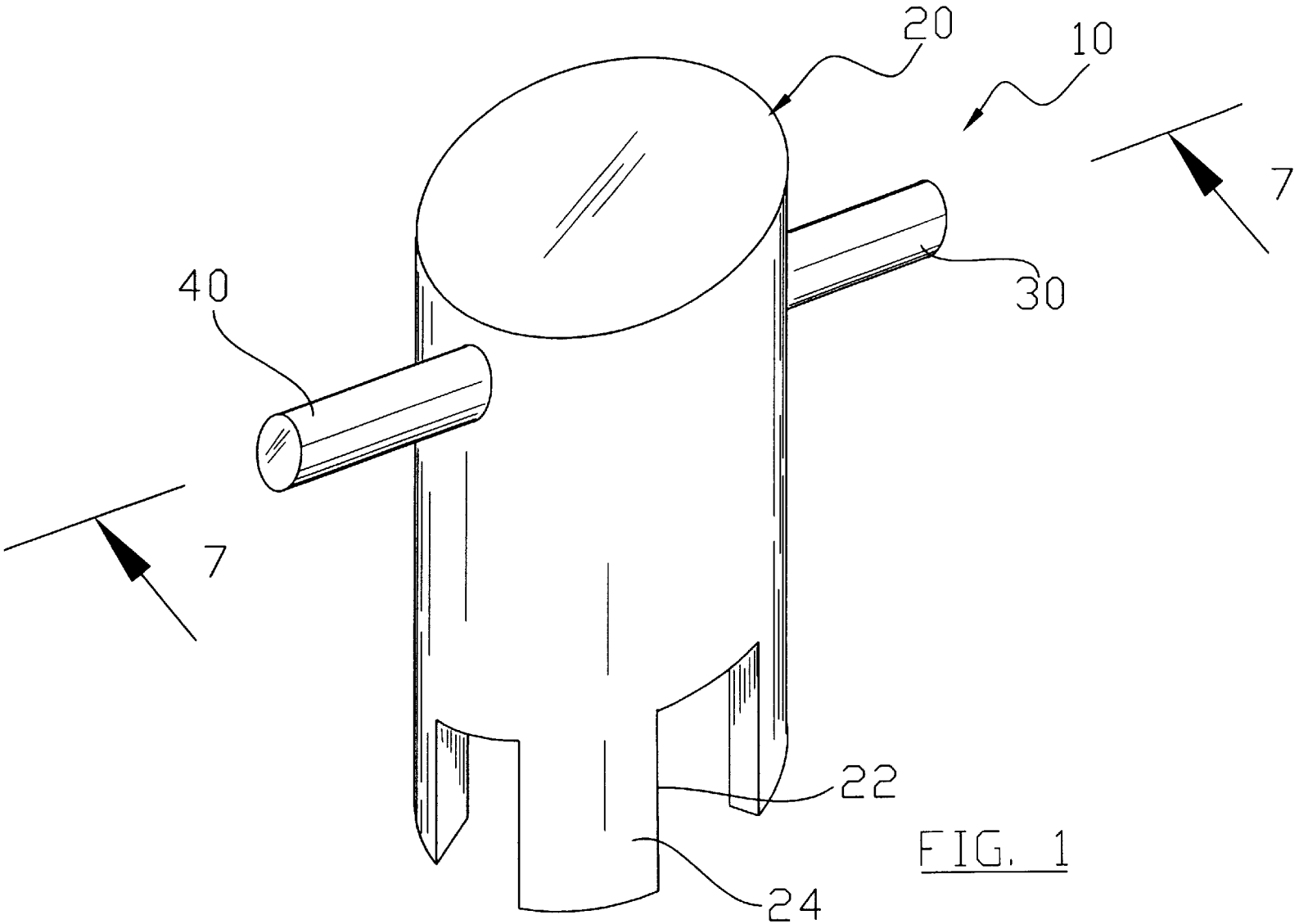
FIG. 1 is an upper perspective view of the present invention.
Figure 2:
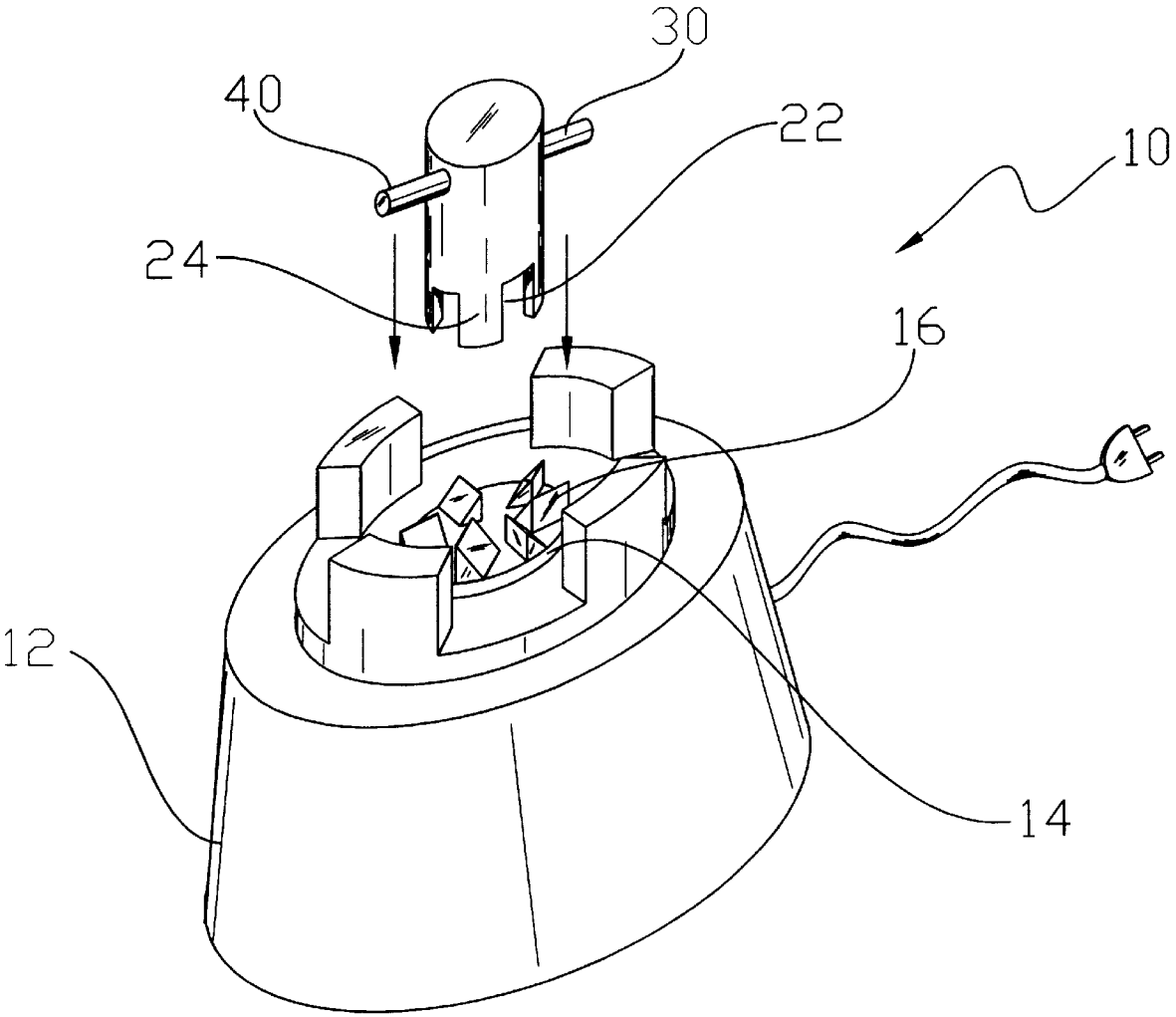
FIG. 2 is an exploded upper perspective view of the present invention positioned above a lower clutch member.

Turning now descriptively to the drawings, in which similar reference characters denote similar elements throughout the several views, FIGS. 1 through 7 illustrate an appliance clutch removal and installation tool 10, which comprises a body member 20 preferably having a relatively elongate structure, a first handle 30 and a second handle 40 attached to an upper end of the body member 20, and a plurality of cutouts 22 extending into a lower end of the body member 20 defining a plurality of engaging members 24. Each of the engaging members 24 has a first side 26 and a second side 28 tapering inwardly from the exterior of the body member 20. The plurality of cutouts 22 receive a corresponding plurality of teeth 16 from the clutch member 14 wherein the plurality of engaging members 24 engage the teeth 16. The user rotates the body member 20 while securing the threaded shaft thereby removing or installing the clutch member 14 about the threaded shaft of the appliance.

As shown in FIGS. 1 through 4 of the drawings, the body member 20 is a generally elongate structure. The body member 20 may be comprised of a hollow or solid structure. The body member 20 may be comprised of various types of materials such as but not limited to plastic and metal. The body member 20 may have various exterior shapes such as but not limited to square or circular.

Figure 7:
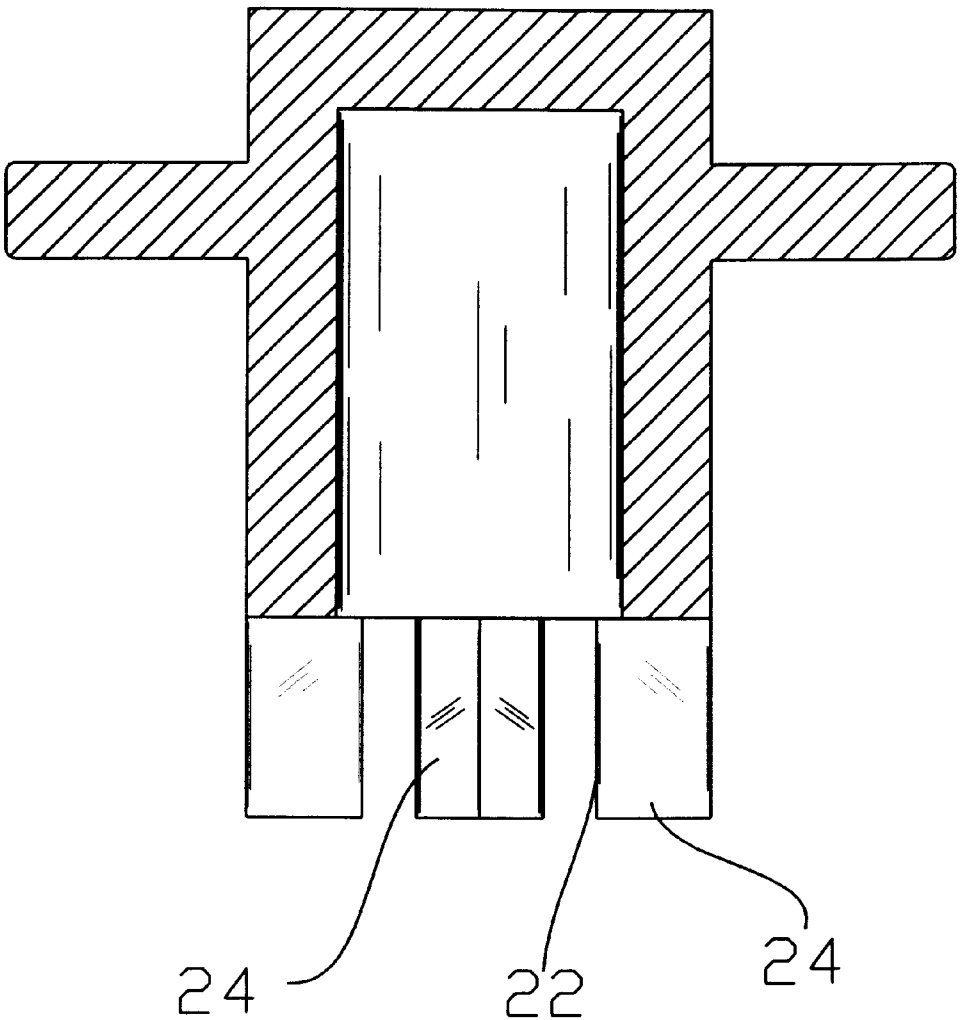
FIG. 7 is a cross sectional view taken along line 7—7 of FIG. 1.

As shown in FIGS. 1 and 7 of the drawings, the body member 20 has an upper end and a lower end. The lower end of the body member 20 is preferably formed of a cavity structure to reduce the likelihood of engaging an obstruction within the center of the clutch member 14. A first handle 30 and a second handle 40 are preferably attached to the upper end of the body member 20. Additional handles may be attached to the body member 20 for allowing an individual to effectively grasp with their hand. The handles 30, 40 preferably have a circular cross sectional shape, however various cross sectional shapes may be utilized to construct the handles 30, 40.

Figure 5:
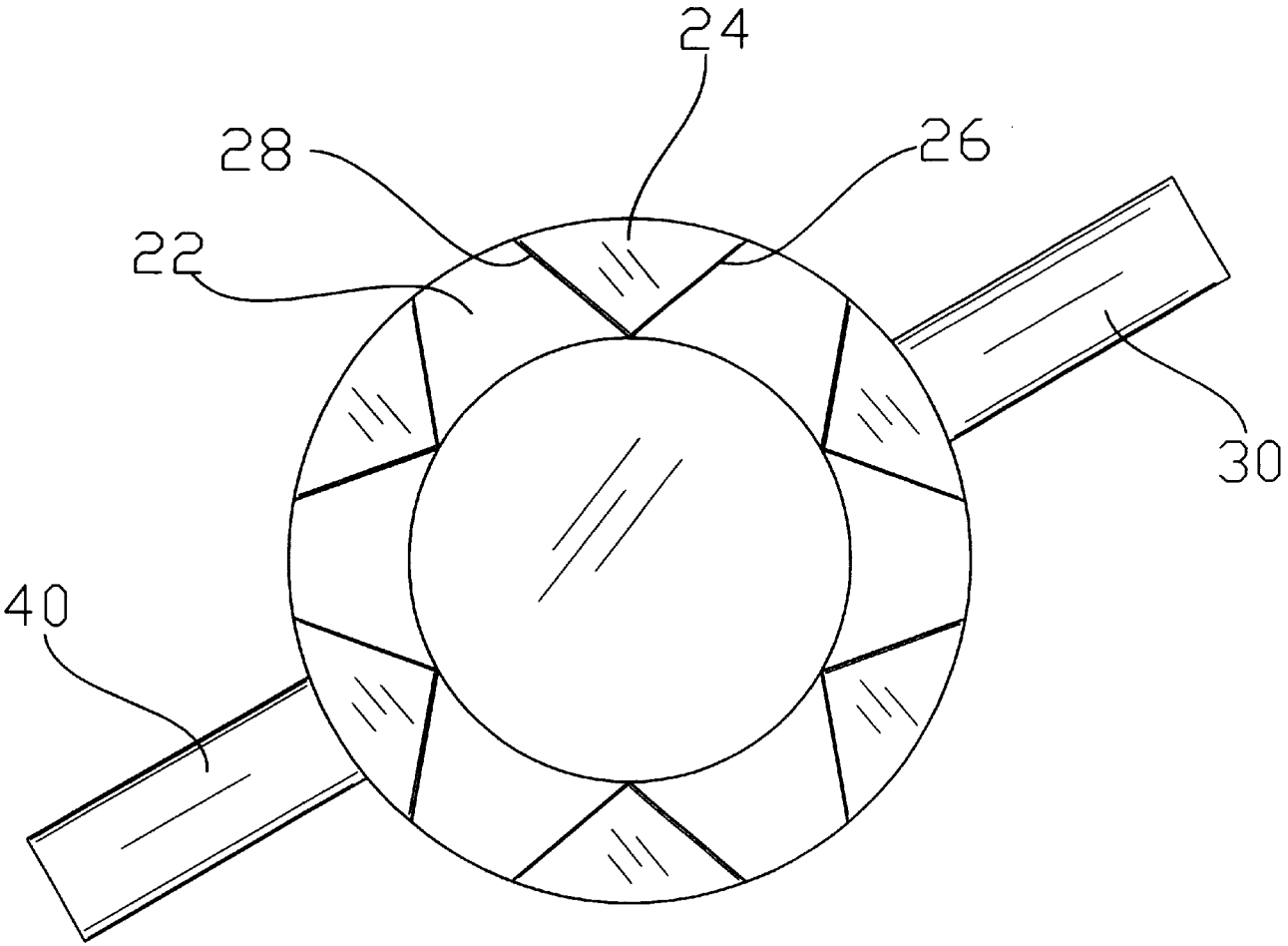
FIG. 5 is a bottom view of the present invention illustrating the engaging members and the cutouts.
Figure 6:
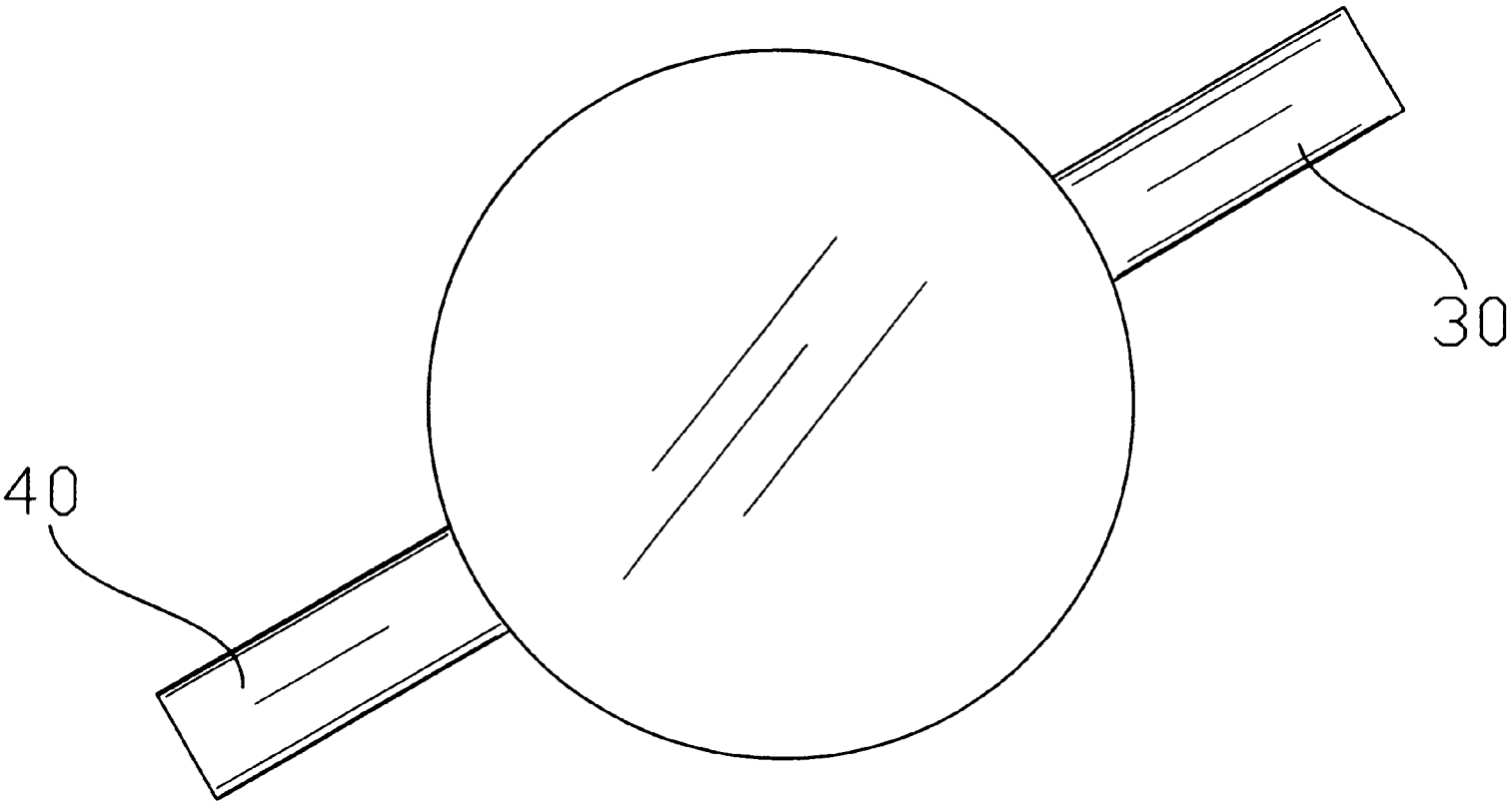
FIG. 6 is a top view of the present invention.

As shown in FIG. 5 of the drawings, a plurality of cutouts 22 extend into the lower end of the body member 20. Each of the cutouts 22 extends upwardly into the body member 20 a distance sufficient to receive an entire tooth 16 of the clutch member 14. The cutouts 22 extend inwardly from the exterior of the body member 20 and become broader as shown in FIG. 5 of the drawings. The number of cutouts 22 preferably equals the number of teeth 16 contained upon the specific clutch member 14. A clutch member 14 typically has six teeth 16, however various numbers of teeth 16 may be utilized upon the clutch.

As further shown in FIG. 5 of the drawings, a plurality of engaging members 24 are formed within the lower end of the body member 20 by the plurality of cutouts 22. Each of the plurality of engaging members 24 has a first side 26 and a second side 28 in opposition to one another. The first side 26 and the second side 28 are formed at an angle with respect to one another as best shown in FIG. 5 of the drawings. As further shown in FIG. 5 of the drawings, the first side 26 of a pair of opposing engaging members 24 is substantially parallel to one another. Furthermore, the second side 28 of a pair of opposing engaging members 24 is substantially parallel to one another. When engaging the teeth 16 of the clutch member 14, either the first side 26 or the second side 28 of the engaging members 24 will be engaging the surface of the teeth 16. It should be noted that the sides 26, 28 of the engaging members 24 do not extend radially from a center of the body member 20.

Figure 3:
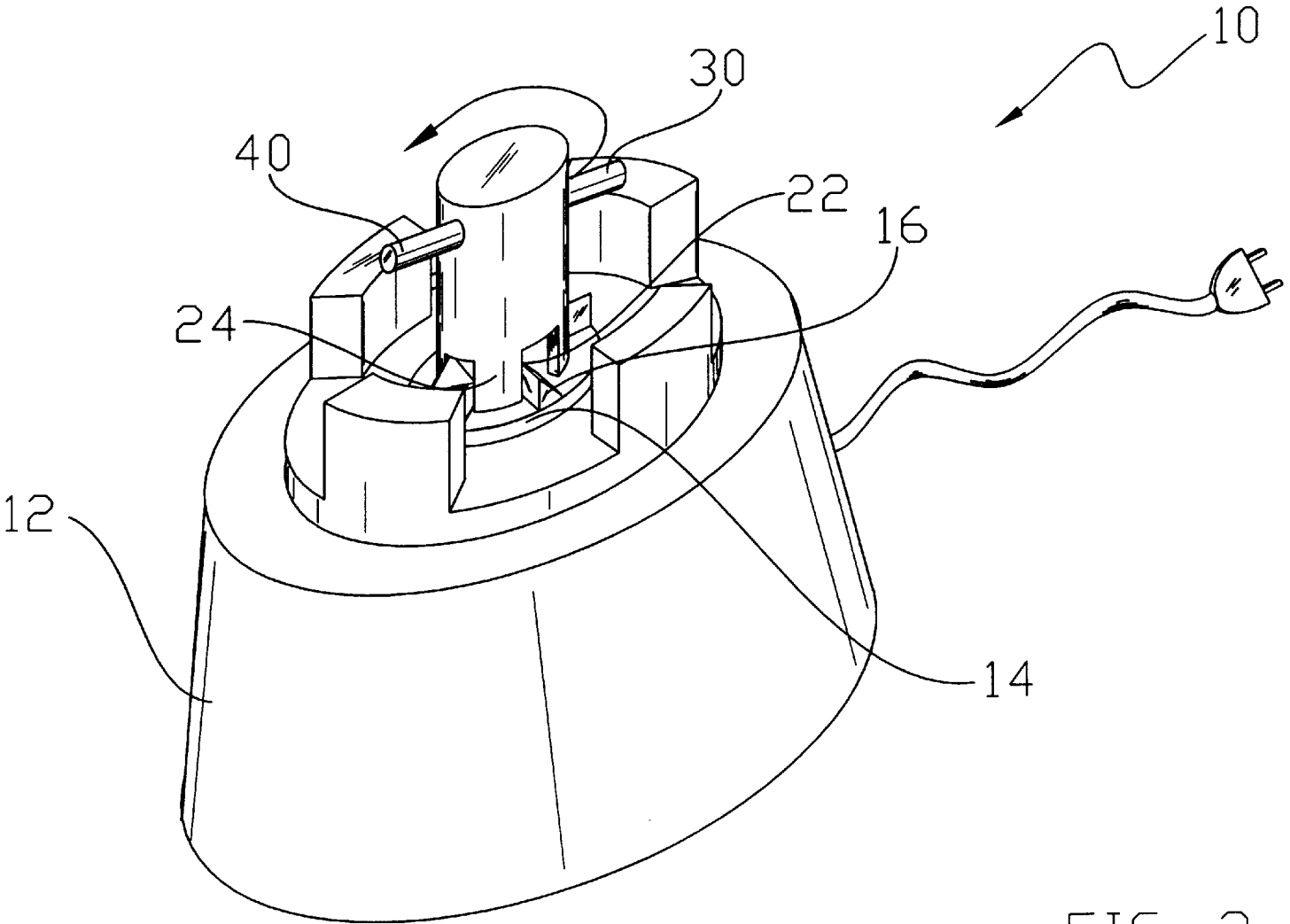
FIG. 3 is an upper perspective view of the present invention engaged to the lower clutch member.

When replacing a lower clutch member 14 on a blender 12 or similar appliance, the user locks the threaded shaft connected to the motor. The user then positions the engaging members 24 between the teeth 16 of the lower clutch member 14 as shown in FIG. 3 of the drawings. The user then rotates the appliance clutch removal and installation tool 10 in the same direction as the normal rotation of the lower clutch member 14 which is required to loosen and remove the lower clutch member 14 from the threaded shaft. To install a new clutch member 14, the user simply repeats the above process.

Figure 4:
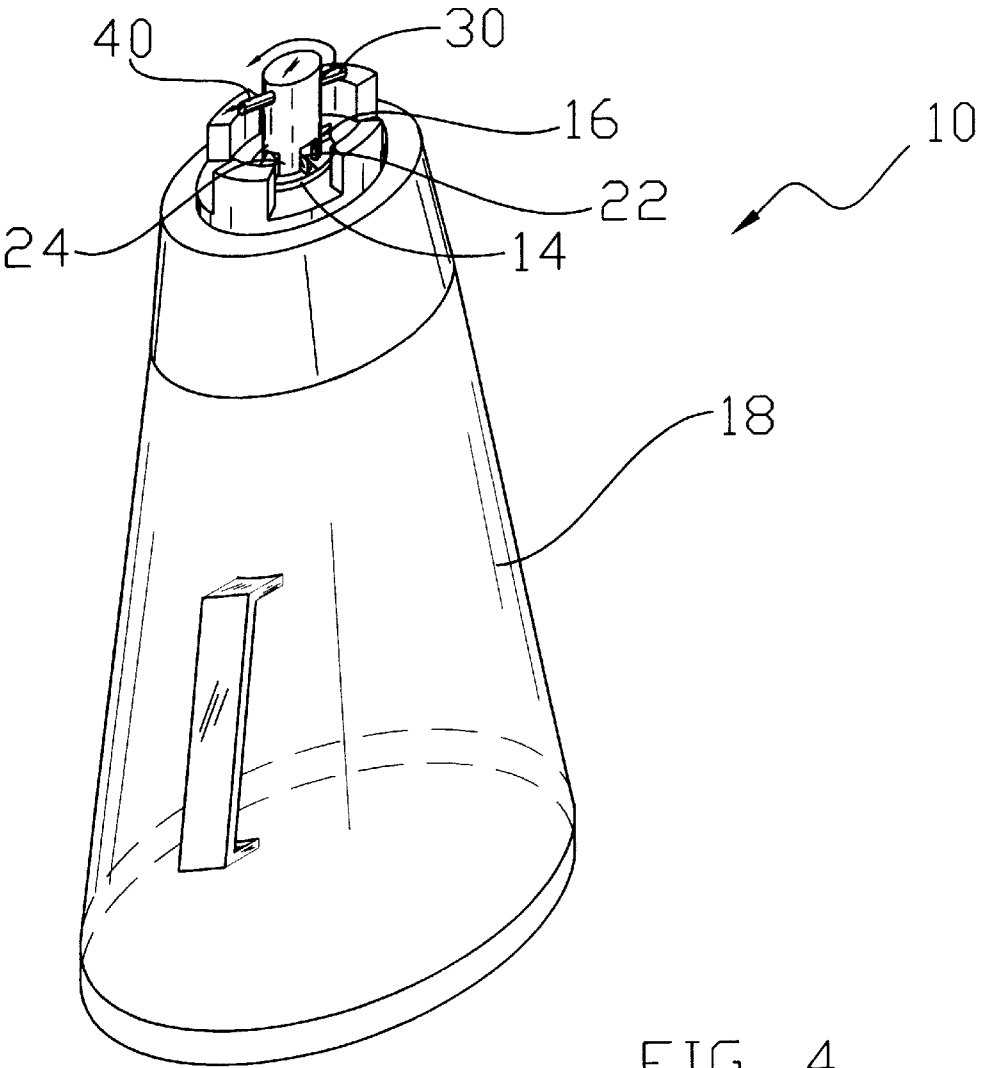
FIG. 4 is an upper perspective view of the present invention engaged to an upper clutch member.

To replace an upper clutch member 14 attached within a container 18 of the blender 12, the user first grasps the blades within the container 18 with a protective member such as a thick cloth or glove. The user then positions the engaging members 24 about the teeth 16 of the upper clutch and then rotates the appliance clutch removal and installation tool 10 in the same direction as the normal rotation of the upper clutch member 14 to remove from the threaded shaft attached to the blades as shown in FIG. 4 of the drawings. To install a new clutch member 14, the user simply positions the new upper clutch member 14 upon the threaded shaft and then rotates the appliance clutch removal and installation tool 10 in a direction opposite of the normal rotation of the upper clutch member 14 until tightened while grasping the blades with the protective member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An appliance clutch removal and installation tool for removing and installing a clutch member with respect to an appliance, comprising:

a body member having a lower end and an upper end, wherein said body member is comprised of a hollow structure;

at least six cutouts extending into said lower end of said body member for receiving a plurality of teeth from a clutch member, wherein said cutouts become broader toward an inner portion of said body member;

at least six engaging members extending between each of said cutouts for engaging a plurality of teeth from a clutch member, wherein each of said engaging members includes a first side and a second side forming a substantially triangular cross sectional shape; and wherein said first side of opposing engaging members are substantially parallel to one another, and wherein said second side of opposing engaging members are substantially parallel to one another.

2. A method of utilizing an appliance clutch removal and installation tool for removing and installing a lower clutch member on a blender, said appliance clutch removal and installation tool comprising a body member having a lower end and an upper end, a first handle attached to said upper end of said body member, a second handle attached to said upper end of said body member, a plurality of cutouts extending into said lower end of said body member for receiving a plurality of teeth from a clutch member, and a plurality of engaging members extending between each of said plurality of cutouts for engaging a plurality of teeth from a clutch member, said method comprising the steps of:

(a) locking a threaded shaft of a motor within said blender;

(b) positioning said engaging members about a plurality of teeth of said lower clutch member;

(c) rotating said appliance clutch removal and installation tool in a first direction, wherein said first direction is the normal rotation of said lower clutch member thereby loosening said lower clutch member from said threaded shaft, said rotating continues until said lower clutch member is removed;

(d) positioning a second lower clutch member upon said threaded shaft;

(e) positioning said engaging members about a plurality of teeth of said second lower clutch member; and (f) rotating said appliance clutch removal and installation tool in a second direction, wherein said second direction is opposite of said first direction thereby tightening said second lower clutch member upon said threaded shaft, said rotating continues until said second lower clutch member is securely attached.

3. The appliance clutch removal and installation tool of claim 2, wherein said cutouts become broader toward an inner portion of said body member.

4. The method of utilizing an appliance clutch removal and installation tool of claim 3, wherein each of said plurality of engaging members includes a first side and a second side.

5. The method of utilizing an appliance clutch removal and installation tool of claim 4, wherein said each of said engaging members has a substantially triangular cross sectional shape.

6. The method of utilizing an appliance clutch removal and installation tool of claim 5, including at least six engaging members.

7. The method of utilizing an appliance clutch removal and installation tool of claim 4, wherein said first side of opposing engaging members are substantially parallel to one another.

8. The method of utilizing an appliance clutch removal and installation tool of claim 4, wherein said second side of opposing engaging members are substantially parallel to one another.

9. The method of utilizing an appliance clutch removal and installation tool of claim 2, wherein said lower end of said body member includes a central cavity portion.

10. The method of utilizing an appliance clutch removal and installation tool of claim 2, wherein said first handle and said second handle extend outwardly away from and concentric with respect to one another.

11. The method of utilizing an appliance clutch removal and installation tool of claim 2, wherein said body member is comprised of a hollow structure.

12. A method of utilizing an appliance clutch removal and installation tool for removing and installing an upper clutch member on a blender, said appliance clutch removal and installation tool comprising a body member having a lower end and an upper end, a first handle attached to said upper end of said body member, a second handle attached to said upper end of said body member, a plurality of cutouts extending into said lower end of said body member for receiving a plurality of teeth from a clutch member, and a plurality of engaging members extending between each of said plurality of cutouts for engaging a plurality of teeth from a clutch member, said method comprising the steps of:

(g) grasping the blades attached to a threaded shaft within said blender in a relatively non-movable manner;

(h) positioning said engaging members about a plurality of teeth of said upper clutch member;

(i) rotating said appliance clutch removal and installation tool in a first direction, wherein said first direction is the normal rotation of said upper clutch member thereby loosening said upper clutch member from said threaded shaft, said rotating continues until said upper clutch member is removed;

(j) positioning a second upper clutch member upon said threaded shaft;

(k) positioning said engaging members about a plurality of teeth of said second upper clutch member; and (l) rotating said appliance clutch removal and installation tool in a second direction, wherein said second direction is opposite of said first direction thereby tightening said second upper clutch member upon said threaded shaft, said rotating continues until said second upper clutch member is securely attached.

13. The appliance clutch removal and installation tool of claim 12, wherein said cutouts become broader toward an inner portion of said body member.

14. The method of utilizing an appliance clutch removal and installation tool of claim 13, wherein each of said plurality of engaging members includes a first side and a second side.

15. The method of utilizing an appliance clutch removal and installation tool of claim 14, wherein said each of said engaging members has a substantially triangular cross sectional shape.

16. The method of utilizing an appliance clutch removal and installation tool of claim 15, including at least six engaging members.

17. The method of utilizing an appliance clutch removal and installation tool of claim 14, wherein said first side of opposing engaging members are substantially parallel to one another.

18. The method of utilizing an appliance clutch removal and installation tool of claim 14, wherein said second side of opposing engaging members are substantially parallel to one another.

19. The method of utilizing an appliance clutch removal and installation tool of claim 12, wherein said lower end of said body member includes a central cavity portion.

20. The method of utilizing an appliance clutch removal and installation tool of claim 12, wherein said first handle and said second handle extend outwardly away from and concentric with respect to one another.

* * * * *